US005493175A

United States Patent [19]

Kani

[11] Patent Number: 5,493,175

[45] Date of Patent: Feb. 20, 1996

[54] PLASMA DISPLAY PANEL

[75] Inventor: Akira Kani, Inuyama, Japan

[73] Assignee: Noritake Co., Ltd., Aichi, Japan

[21] Appl. No.: 129,139

[22] PCT Filed: Feb. 5, 1993

[86] PCT No.: PCT/JP93/00153

§ 371 Date: Oct. 1, 1993

§ 102(e) Date: Oct. 1, 1993

[87] PCT Pub. No.: WO93/16482

PCT Pub. Date: Aug. 19, 1993

[30] Foreign Application Priority Data

Feb. 6, 1992 [JP] Japan ..... 4-054158

[51] Int. Cl.[6] ..... H01J 17/49; H01J 17/16; H01J 9/26

[52] U.S. Cl. ..... 313/584; 313/582; 313/586; 313/238

[58] Field of Search ..... 313/484, 581, 313/582, 583, 584, 586, 238, 634

[56] References Cited

U.S. PATENT DOCUMENTS

| | | | |
|---|---|---|---|
| 3,882,342 | 5/1975 | Kamegaya et al. | 313/485 |
| 4,389,277 | 6/1983 | de Vries | 445/24 X |
| 4,827,186 | 5/1989 | Knauer et al. | 313/485 |
| 4,952,221 | 4/1976 | Kamegaya et al. | 313/485 |
| 5,264,758 | 11/1993 | Iijima et al. | 313/484 |

FOREIGN PATENT DOCUMENTS

| | | |
|---|---|---|
| 50-17965 | 2/1975 | Japan . |
| 53-8649 | 3/1978 | Japan . |
| 55-150532 | 11/1980 | Japan . |
| 62-180845 | 11/1987 | Japan . |
| 3-84832 | 4/1991 | Japan . |
| 4-19942 | 1/1992 | Japan . |

OTHER PUBLICATIONS

Research Disclosure, No. 305, Sep. 1989, Havant GB, p. 637.

*Primary Examiner*—Donald J. Yusko
*Assistant Examiner*—Nimesh D. Patel
*Attorney, Agent, or Firm*—Bucknam and Archer

[57] ABSTRACT

Disclosed is a plasma display panel including a porous metal plate in which a plurality of holes for display cells are formed at positions corresponding to intersections at which a first linear electrode group and a second linear electrode group cross each other with a predetermined interval therebetween, and a front glass plate, wherein openings of the holes of the porous metal plate on the front surface side are larger than openings on the rear surface side, the openings on the rear surface are covered with a molten material of an inorganic dielectric containing glass and are thereby airtightly sealed. This plasma display panel is light in weight and thin and can be easily assembled.

8 Claims, 3 Drawing Sheets

PLASMA DISPLAY PANEL

FIELD OF THE INVENTION

The present invention relates to a plasma display panel.

BACKGROUND ART

As a plasma display panel (hereinafter referred to as a PDP), a direct-current type (DC type) PDP and an alternate-current type (AC type) PDP are known. These PDPs are further classified into a so-called mono-color type PDP using the emission of light by a discharge gas and a color type PDP in which a fluorescent substance is caused to emit visible light by ultraviolet rays generated by discharge. Although the following problems arise in both the color and the nono-color type PDPs, they are significant particularly in the color type PDP, so the color PDP will be described mainly below.

Although various methods of arranging PDPs are known, an air-tight vessel containing a discharge gas, which is manufactured by sealing the peripheral portions of front glass and rear plates opposing each other with sealing glass in order to decrease the thickness of the structure, is frequently adopted. Commonly, inexpensive soda-lime glass is used for both the front and rear plates.

In a color PDP having a large number of fine display cells. diaphragms are formed between the front and rear plates in order to prevent an erroneous discharge or a blur of colors between adjacent cells or to keep the difference between pressures inside and outside the panel, or as spacers for defining the distances between discharge electrodes. A space surrounded by the diaphragms and the front and the rear plates functions as one display cell. A fluorescent substance is deposited on the inner surface of each display cell to emit visible light of each individual color upon irradiation with ultraviolet rays generated by discharge. In the formation of the diaphragms, a thick-film formation technique that prints and calcines a dielectric paste consisting of, e.g., glass on the front and rear plates is used. In addition, methods using a porous metal plate have been proposed by the present inventors in Japanese Patent Application Laid-Open gazette Nos. 3-152830, 3-205738 and 4-19942. The present invention relates to a color PDP using this porous metal plate.

In the color PDP having a large number of fine display cells capable of displaying images, a matrix cell arrangement in which cells and electrodes can be formed easily is generally adopted. It is convenient to form a number of cells at the intersections of linear row- and column-discharge electrodes formed in a matrix manner. Each group of the row- and column-electrodes is a first or second electrode group, and a large number of cells can be selected independently of one another in these two electrode groups. Therefore, the types of first and second electrode groups are not particularly limited as long as a number of cells can be selected.

In the DC type PDP, linear cathodes are formed on a front glass plate or a rear plate, and linear anodes are formed on a substrate opposing the cathodes, such that both the cathodes and the anodes are exposed to a discharge gas and cross each other with diaphragms between them. Alternatively, the cathodes and the anodes can be formed on the same substrate to cross each other via a dielectric. An arrangement using an auxiliary discharge electrode in addition to the first and second electrode groups is also known.

The AC type PDP is similar to the DC type PDP except that discharge electrodes are covered with a dielectric, so two linear electrode groups can also be formed in the AC type PDP. Write electrodes can be formed on the same substrate as the discharge electrodes via an insulating layer. In some DC type PDPs, one of a pair of electrode groups is formed to cross the other via an insulating layer, making the use of write electrodes unnecessary. There is another known arrangement in which the electrodes of one of a pair of discharge electrode groups covered with a dielectric are connected together in units of cells, and electrodes for selection, so-called write electrodes are used as exposed electrodes.

A fluorescent substance is formed on a substrate opposing a substrate on which the cathodes or the discharge electrodes are formed. This is essential to prevent deterioration in the fluorescent substance due to positive ions generated by discharge.

In the DC and the AC type PDPs, colored glass layers are sometimes formed on the front and rear plates in order to shield light and improve contrast. External extracting terminals are also required.

In these color PDPs, many of constituting elements such as circuits arc formed on the front and rear plates. Therefore, the color PDP is assembled by setting three primary components, i.e., the front glass plate, the rear plate, and the diaphragm plate made of a porous metal plate to their respective predetermined positions. That is, the thickness of a display portion of the color PDP is the sum total of the thicknesses of the front and rear plates on which the individual constituting elements are formed and the thickness of the diaphragm plate.

When glass is used for the front and rear plates, a thickness meeting the dimensions of the glass plate required for panel formation is necessary for convenience in operation. As an example, thicknesses of 1 mm, 2 mm, and about 5 mm are required for diagonal dimensions of the display portions of 6 to 10 inches, 10 to 20 inches, and 40 inches or more, respectively. This thickness of the rear plate cannot be neglected in a flat display panel required to be light in weight and thin.

In addition, the arrangement constituted by the front and rear plates and the diaphragm plate requires two-time positioning, i.e., the number of times of positioning is larger than that in a PDP constituted by the front and rear plates alone. That is, the number of times of positioning is increased as the number of parts increases, and this disadvantage is significant particularly in a color PDP manufactured through cumbersome steps and having fine cells.

At present, as described above, many problems are left unsolved in the conventional PDPs.

The present invention has been made in consideration of the above conventional situations, and has as its object to provide a PDP which is light in weight and thin and can be assembled easily.

DESCRIPTION OF THE INVENTION

The present inventors have made extensive studies to solve the above conventional problems and reached the present invention.

That is, the present invention is a plasma display panel comprising a porous metal plate in which a plurality of holes for display cells are formed at positions corresponding to intersections at which a first linear electrode group and a second linear electrode group cross each other with a predetermined interval therebetween, and a front glass plate, wherein the openings of the holes of the porous metal plate on the front surface side are larger than the openings on the rear surface side, the openings on the rear surface side are covered with a molten material of an inorganic dielectric containing glass and are thereby air-tightly sealed.

The present invention will be described in more detail below.

As the front glass plate, soda-lime glass for windows is preferred because of its low cost. Although transparent glass materials consisting of other components are also usable, these glass materials need be selected by taking into account thermal expansion compatibility with other materials and a heat resistance because there is a problem of a large number of heat-bonding steps in addition to the problem of cost.

The porous metal plate as the characteristic feature of the present invention will be described next.

The porous metal plate for forming the display cells is well-known as described in "Background Art" and its usefulness is also obvious. Since the porous metal plate is brought into tight contact with the front glass plate, a metal with a thermal expansion coefficient close to that of the glass substrate is selected. Preferable examples of the porous metal are a 42 wt % Ni-6 wt % Cr-Fe alloy and a 50 wt % Ni-Fe alloy, when the substrate consists of soft glass, and a 20 wt % Ni- 17 wt % Co-Fe alloy and a 42 wt % Ni-Fe alloy, when the substrate consists of hard glass. Any of these exemplified metals is excellent in heat resistance and thermal oxidation resistance and causes only a small dimensional change falling within the range of measurement errors when heated up to 700° C. in the air. In addition, similar to general metals, the proccessability of each of these metals is high, so display cells with a pitch of 0.15 mm or less can be formed when a 0.1-mm thick metal plate is processed by etching. Furthermore, since these metals are also excellent in mechanical characteristics, the operability is high even for a metal plate with a thickness of 0.1 mm or less.

It is convenient to perform the following processing for the metal plate in addition to the formation of holes for the display cells: extending the metal plate to the periphery of a display portion to form a hole for exhaust or gas sealing or forming dot-like holes or a stripe structure for fixing or sealing the metal plate to the front glass plate. The former processing is convenient in connecting an exhaust pipe, and it is preferable to form a groove in the surface of the metal plate on the glass plate side from this hole to a portion near the display portion because ventilation of gas can be performed reliably. The latter processing is effective to increase an amount of an adhesive, thereby increasing the strength of adhesion or sealing. All these structures together with the holes for display cells can be formed at one time by using etching in the processing. Although these structures can be formed in a plurality of two-dimensionally divided metal plates, it is convenient to perform the processing in a single metal plate.

The holes for display cells are through-holes having substantially the same sizes arranged in a matrix manner, each having a larger opening on the display surface side and a smaller opening on the rear surface side. A large opening is required on the display surface side to perform display. The opening in the rear surface is preferably small for the purpose of air-tight sealing and need not be large. In order for electrodes formed on the rear surface to contact display cell spaces or when a printing technique is used in depositing a fluorescent substance on the inner surfaces of cells, the rear-surface holes are required to suck an ink from the rear surface. The smaller the rear-surface holes, the larger the area for depositing a fluorescent substance, and this results in a high luminance. The use of the etching described above can easily form holes having upper and lower openings with different sizes even in a single metal plate by using different mask patterns on the front and the rear surfaces. It is also possible to form finer or more complicated cells by stacking a plurality of porous metal plates one atop the next, but the manufacturing cost is increased compared to that when a single metal plate is used.

It is preferable to cover at least a portion of the surface of the porous metal plate with an inorganic dielectric. In this case, one of electrode groups can be formed on the rear surface of the porous metal plate by using the coated dielectric. This electrode group is a cathode, an anode, an auxiliary discharge electrode, or the like in the case of a DC type PDP, and a discharge electrode, a write electrode, or the like in the case of an AC type PDP, including interconnections of these electrodes. These electrode portions are also formed on the inner surfaces of the rear-surface openings in the porous metal plate so as to contact the display cell spaces. Preferably, the small-opening portions in the rear surface are filled with an electrode material. An insulating layer required for forming the electrode group, external terminals, and the like can also be formed on the rear surface. It is also known to those skilled in the art to use the porous metal plate constituting the diaphragm plate as a common electrode for a plurality of cells. Examples are an auxiliary discharge electrode covered with a dielectric in a DC type PDP and a common discharge electrode in an AC type PDP. It is of course possible to form other circuits on the surface of the porous metal plate on the glass substrate side. To prevent these circuits from shorting, therefore, the circuits are formed after the porous metal plate is coated with the dielectric. When prevention of short circuits of a plurality of electrodes formed on the glass substrate is also taken into account, it is desirable to coat substantially the entire surface of the porous metal plate with the dielectric. This dielectric coating method is described in detail in the patent applications described above and Japanese Patent Application Laid-Open Gazette No. 4-147535. The use of a glass-containing inorganic dielectric capable of easily forming a dense layer is preferable in order that the dielectric not be short-circuited with the electrodes formed on it.

Well-known thick-film or thin-film formation techniques are applicable as the method of forming color PDP constituting elements, such as circuits, on the porous metal plate. These techniques are described in detail in Japanese Patent Application Laid-Open Gazette No. 5-159706 proposed by the present inventors.

The characteristic feature of the present invention is the nonuse of a rear plate. That is, the conventional cell diaphragm also serves as a rear plate. Therefore, the holes in the rear surface of the porous metal plate must be air-tightly sealed.

An inorganic substance containing glass is used for this air-tight scaling. This sealing material may be either glass or a composite substance of glass and a metal or glass and ceramic. Glass may be amorphous glass or vitrified glass which precipitates crystals at a specific temperature. Oxide-based glass is preferred for easy melting of glass in the air. The sealing temperature is within the range over which PDP circuits formed in advance are not damaged and is higher than the temperature at exhaust or the temperature at which the periphery of the PDP is scaled. In the present invention, the sealing temperature is preferably 450° C. to 750° C., and more preferably 550° C. to 700° C. The thermal expansion of the sealing material is adapted to that of a material to be sealed. A number of such sealing materials, such as glass, are known and can be selectively used.

The use of these materials in the form of a powder is preferred for convenience in processing. A material formed by kneading a solid powder with a liquid vehicle can be easily coated or printed. This liquid vehicle is generally prepared by dissolving a resin in a solvent and functions to coat a powder at a predetermined position and temporarily fix it to that position. The liquid vehicle is scattered away at a temperature of drying or sealing processing.

The small holes in the rear surface of the porous metal plate are covered with the sealing material from the rear surface side. As a result, recessed portions are formed on the display surface side. In this case, penetration of the sealing material into the display cells having wider interiors than those of the small holes in the rear surface is not preferred. This is so because the effective display portion is decreased or a fluorescent substance deposited inside the cells is contaminated. The size of the small holes is important to obtain the above state when the small holes are covered with the sealing material. Although the small holes can be filled with a material other than the sealing material, this filling can be performed by simple coating. The size of the small holes, particularly the minimum width of the small holes is preferably 300 μm or less. If the minimum width is larger than 300 μm, the coating material easily spreads out into the display cells to make filling of the small holes difficult. In addition, if the holes are large, the sealing material must be coated thick in order to keep the difference between pressures inside and outside the PDP. This not only wastes the material but interferes with the formation of a thin PDP. The size of particles of the coating material is preferably large in order to fill the holes, but a smaller size is advantageous for the purpose of fine pattering. In the present invention, the average particle size of a sealing material, such as a glass powder, is preferably 5 to 30 μm. It is also possible to use a composite material of glass and a conductive substance as the sealing material so that the material can also be used as an electrode.

BRIEF DESCRIPTION OF THE DRAWINGS

FIGS. 4A and 4B are partial schematic plan and sectional views, respectively, for explaining another circuit configuration on a front plate according to the present invention.

Referring to FIGS. 1 to 4B, reference numeral 1 denotes a front glass plate; 2, a porous metal plate; 3, cathodes; 4, anodes; 5, interconnections; 6, terminals; 7, a notched stripe portion; 8, dot-like small holes; 9, low-melting sealing glass; 10, an exhaust hole; 11, a groove; 12, a diaphragm; 13, a coating layer; 14, a fluorescent substance; 15, a common discharge electrode; 16, a scanning discharge electrode; 17, an insulating layer; and 18, an MgO protective layer.

DESCRIPTION OF THE PREFERRED EMBODIMENTS

Figure 1:
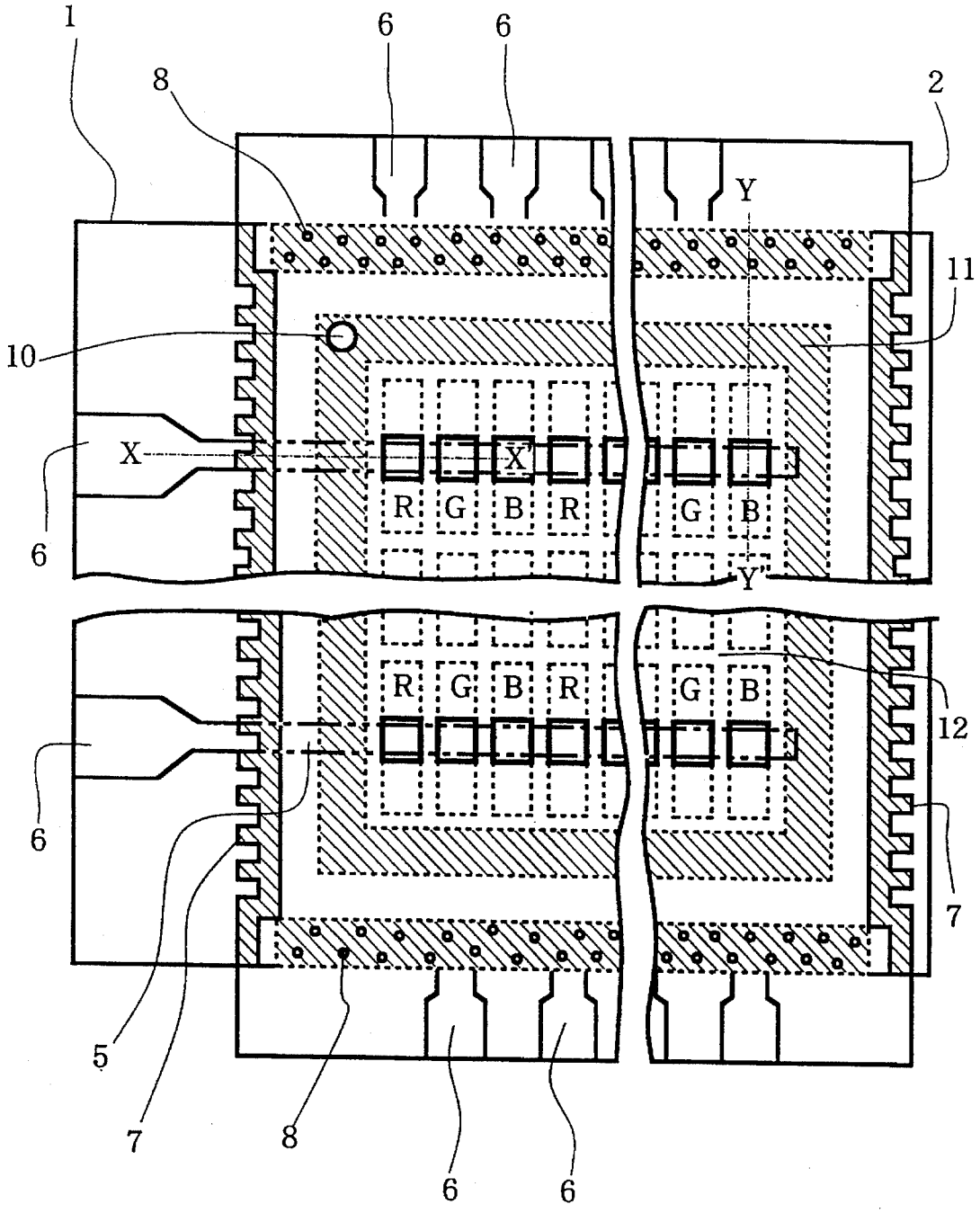
FIG. 1 is a schematic plan view for explaining one embodiment of a PDP according to the present invention.

The embodiments of the present invention will be described in more detail below.

Formation of PDP

Soda-lime glass for windows was used as a front glass plate, and a porous metal plate was made by etching a 0.15-mm thick 42 wt % Ni-6 wt % Cr-Fe alloy plate. An $SiO_2$—$B_2O_3$—PbO—$Al_2O_3$—ZnO glass powder was electro-deposited by using the porous metal plate as an electrode and fusion-bonded at 650° C., thereby covering substantially the entire surface of the porous metal plate with a dense dielectric. The thickness of the dielectric was approximately 10 μm. Small holes formed in the rear surface were square holes about 130 μm wide, and each hole was formed in a substantially central portion of a display cell. The thickness of this portion was about 60 μm. The ink to be explained below was filled into these small holes by squeezing. That is, the ink was formed by kneading a total of 100 parts by weight of 35 wt % of an $SiO_2$—$B_2O_3$—PbO—$Al_2O_3$—ZnO glass powder about 10 μm in average particle size and 65 wt % of an Au powder about 0.6 μm in average particle size with 40 parts by weight of a liquid vehicle prepared by dissolving 15 wt % of ethylcellulose in butyl carbitol acetate. An Ag paste was printed to have a thickness of approximately 6 μm on the filled small holes and the rear surface of the porous metal plate, forming one electrode group. Thereafter, a glass paste of the same system as the filling ink was printed to have a thickness of about 50 μm so as to cover the portion of the small holes, thereby sealing the small holes. This glass coating layer ensures the air-tight sealing of a display portion and at the same time serves as an insulating protective layer of the conductor layer. The firing temperature for the filled ink, Ag, and the glass paste is 600° C., so these materials do not deform at a sealing temperature of 480° C. for low-melting seal glass to be described below.

The non-sealed surface of the porous metal plate thus formed was aligned with a predetermined position of the front glass plate, and the four peripheral sides of the display portion were sealed with the low-melting seal glass, thereby forming a PDP. Note that formation of circuits and the like not described above was performed by applying a thick-film formation technique, the fluorescent substance was calcined at 500° C., and the other materials were calcined at 550° C. to 590° C. An exhaust pipe was connected to the exhaust hole of the PDP, a predetermined discharge gas was filled after exhaust was performed, and then the exhaust pipe was chipped off. After aging was performed, a normal light emission was confirmed.

Note that known methods were used in steps except for those described above.

Example 1

Figure 2:
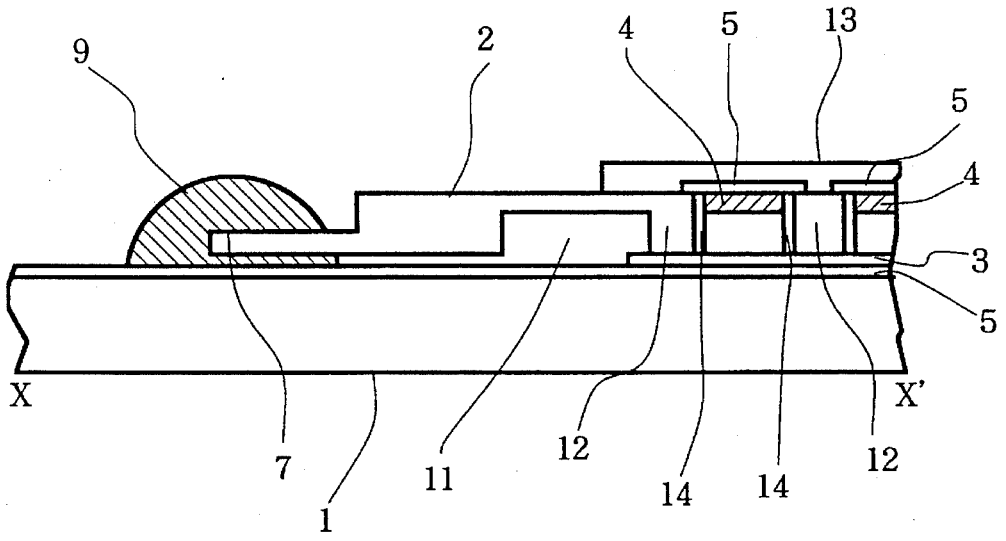
FIG. 2 is a schematic sectional view taken along a line X–X' in FIG. 1.
Figure 3:
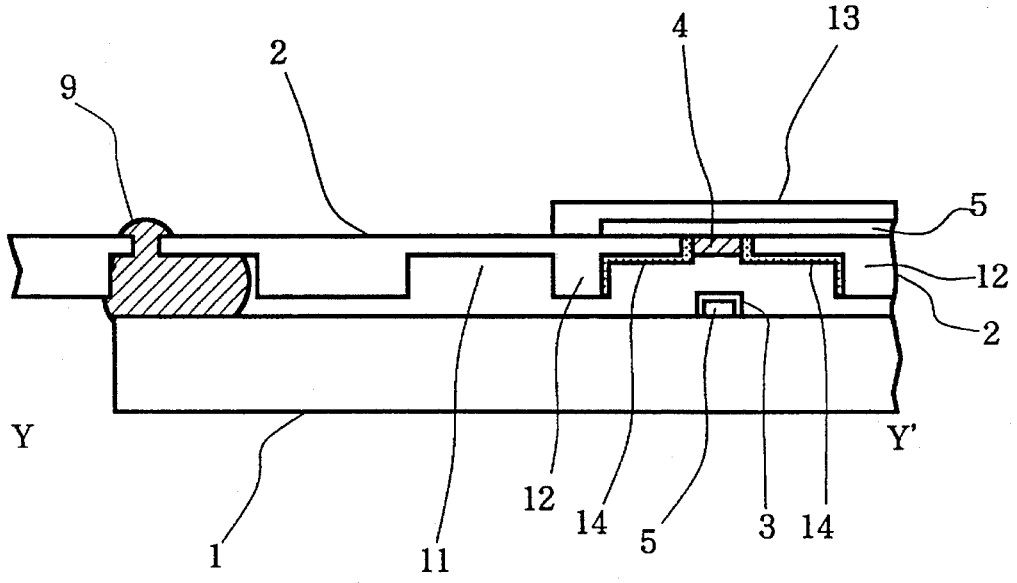
FIG. 3 is a schematic sectional view taken along a line Y–Y' in FIG. 1.

FIG. 1 is a schematic plan view showing the PDP viewed from the rear surface side, FIG. 2 is a schematic sectional view taken along a line X–X' in FIG. 1, and FIG. 3 is a schematic sectional view taken along a line Y–Y' in FIG. 1. In FIGS. 1 to 3, common reference numerals are used, so the same reference numerals denote the same parts.

A front glass plate 1 had a length of 380 mm, a width of 510 mm, and a thickness of 2.4 mm, and Ag interconnections 5 of about 5 μm thick were formed on the front glass plate 1. The width of each interconnection in a display portion was 120 μm, the width of each terminal 6 was 350 μm, and the pitch of both the interconnections and the terminals was 750 μm. A paste of a conductive oxide powder consisting of $La_{0.7}Sr_{0.3}MnO_3$ was coated to have a thickness of approximately 6 μm and a width of 140 μm on interconnections of the display portion, thereby forming cathodes 3.

A porous metal plate 2 had a length of 400 mm and a width of 490 mm. A notched stripe portion 7 was formed on each side portion in the longitudinal direction of the porous metal plate 2, and the rear surface of each stripe portion 7 was thinned by half-etching. Dot-like small holes 8 were formed in the side portions in the lateral direction of the glass plate at positions facing glass, and portions around the small holes 8 on the display surface side were half-etched. These half-etched portions are portions for coating low-melting glass 9 (not shown in FIG. 1) for sealing the whole PDP. An exhaust hole 10 was formed between the coating portions and the display portion, and tile peripheral portion including the exhaust hole of the display portion on the display side was half-etched, thereby forming a grove 11. These half-etched portions are indicated as hatched portions (FIG. 1).

As the arrangement of display cells, substantially rectangular cells each having a longitudinal pitch of 750 μm and a lateral pitch of 250 μm were arranged in a matrix manner. The widths of a diaphragm portion 12 were about 150 μm in the longitudinal direction and about 80 μm in the lateral direction. The number of cells was 480 (rows)×1,920 (columns).

An electrode group on the rear surface of the porous metal plate 2 was constituted by anodes 4 formed by filling carbon in the small holes, Ag interconnections, and terminals (these components are not shown in FIG. 1 except for tile terminals). Each interconnection had a width of 170 μm, the interconnections had a pitch of 250 μm, and every other interconnection was extended to the upper or the lower portion and connected to a terminal with a width of 250 μm and a pitch of 500 μm. The entire display portion including the small holes constituting the anodes was covered with a coating layer 13 (not shown in FIG. 1) consisting of a glass paste and was thereby air-tightly sealed.

Red (R), green (G), and blue (B) fluorescent substance 14 was coated on the inner surfaces of the holes on the display surface side of the porous metal plate such that the cells of these three colors were striped.

A sealed gas used was He—Xe (5%) at a pressure of 350 Tort.

The PDP thus manufactured was of a DC type, and the thickness of the display portion was approximately 2.7 mm.

Example 2

Figure 4:
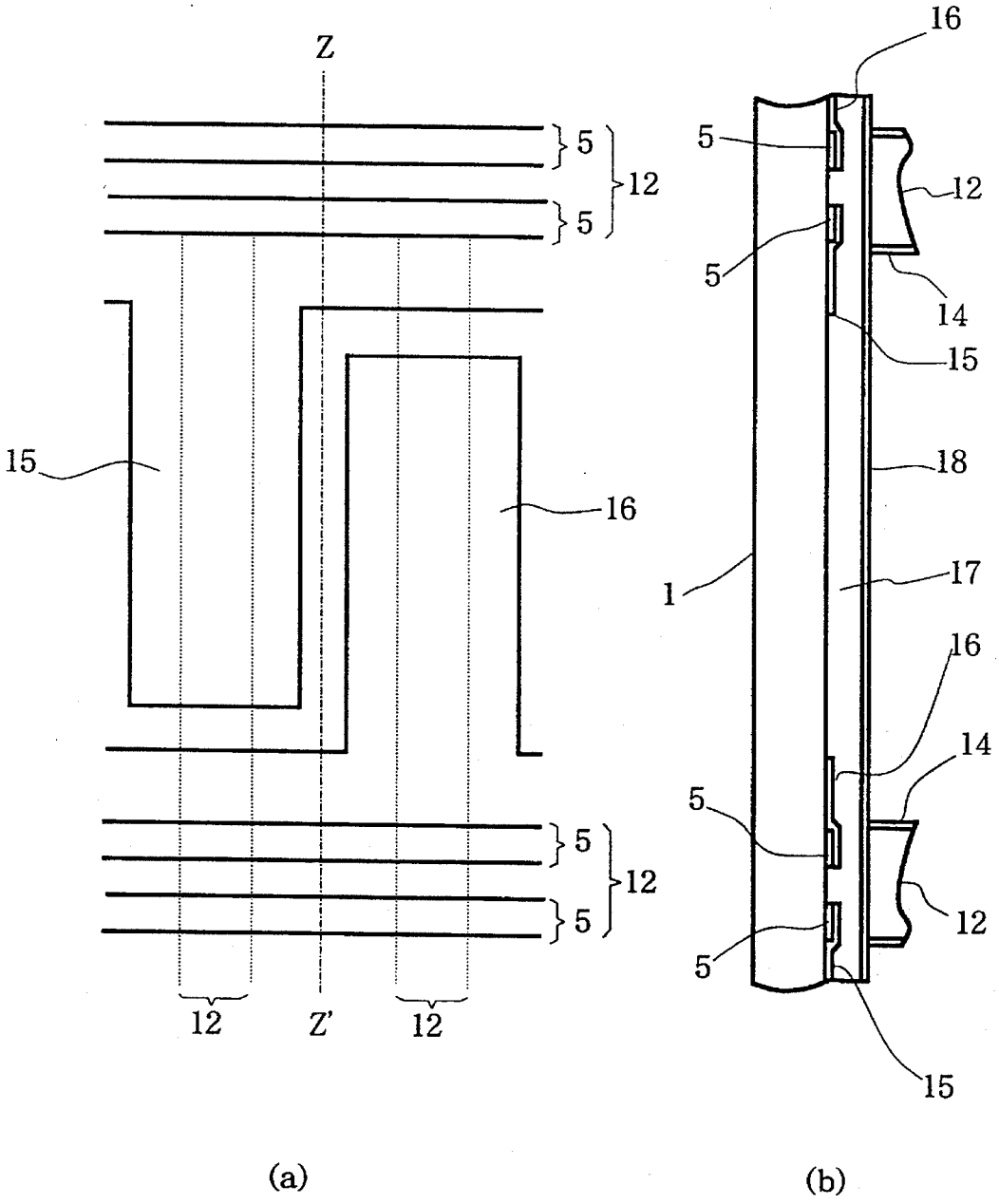

FIGS. 4(*a*) and 4(*b*) are views showing the circuit configuration on a front glass plate, in which FIG. 4A is a partial schematic plan view showing one display cell, and FIG. 4B is a sectional view taken along a line Z–Z' in FIG. 4A. Diaphragms 12 are also illustrated. Each interconnection 5 connected to a terminal consisted of A1 had a thickness of about 1 μm and a width of 50 μm. A common discharge electrode 15 and a scanning discharge electrode 16 were formed to cover these interconnections 5. These electrodes were transparent conducting films of an In—Sn oxide about 0.6 μm thick. These electrodes 15 and 16 opposed each other with a 40-μm wide zigzag interval between them. The interconnections 5 and the electrodes 15 and 16 were formed and patterned through sputtering and etching. The interconnections of the common discharge electrode were connected together outside the screen. An insulating layer 17 about 40 μm thick consisting of transparent glass was coated, and an MgO protective film 18 with a thickness of approximately 0.2 μm was coated on the insulating layer 17 by sputtering. The electrodes formed on the rear surface of the porous metal plate served as write electrodes. Any other arrangement was the same as that of Example 1.

The PDP thus manufactured was of an AC type, and the thickness of the display portion was approximately 2.7 mm.

Example 3

A front glass plate had a length of 180 mm, a width of 240 mm, and a thickness of 1.1 mm, and Al interconnections about 1 μm in thickness were formed on this front glass plate. The width and pitch of each interconnection in the central portion of a display portion were 50 μm and 300 μm, respectively, and every other interconnection was extended to the right or the left and connected to a terminal with a width of 300 μm and a pitch of 600 μm. A conductive oxide consisting of $La_{0.7}Sr_{0.3}MnO_3$ was coated to have a thickness of about 0.6 μm and a width of 210 μm on interconnections in the display portion, thereby forming transparent cathodes. The cathodes and the interconnections were formed by sputtering and patterned by etching.

The dimensions of a porous metal plate 2 were a length of 200 mm and a width of 220 mm. As the arrangement of display cells, square cells were arranged in a matrix manner with a pitch of 300 μm in both the row and the column directions. The width of a diaphragm portion was approximately 90 μm. The number of cells was 480 (rows)×640 (columns). No fluorescent substance was coated on the display portion.

A sealed gas used was Ne—Ar (0.5%) at a pressure of 250 Torr.

The other arrangement was substantially the same as that of Example 1. The PDP thus manufactured was of a DC type, and the thickness of the display portion was about 1.4 mm.

As is apparent from the above examples, the color PDP of the present invention can be applied to various types of PDPs, and particularly thin PDPs can be obtained. For example, the thickness of the PDP can be decreased by about 2.4 mm in Examples 1 and 2 and about 1.1 mm in Example 3 from those of conventional PDPs. It is also obvious that positioning need only be performed once.

As is apparent from the above description, since no conventional rear plate is used in the present invention, a PDP which is light in weight and thin and can be assembled easily can be obtained. In addition, the weight of each PDP obtained by the present invention can be decreased by the weight of one rear plate. Furthermore, the number of times of positioning is decreased as compared with those in conventional structures because the number of components is small.

What is claimed is:

1. A plasma display panel device comprising an air-tight vessel containing a discharge gas, a first group of linear electrodes and a second group of linear electrodes, which intersect each other at intersections, a plurality of display cells, said vessel being formed by a front glass plate and a porous metal plate having a front surface side and a rear surface side, said porous metal plate having a plurality of through-holes for said display cells, said through holes being formed at positions corresponding to said intersections at which said first group of linear electrodes and said second group of linear electrodes cross each other with a predetermined interval therebetween, a diaphragm for dividing adjacent display cells and supporting said front glass plate and said porous metal plate against external pressure, wherein said porous metal plate provided with said through-holes functions as a rear panel, said through-holes having smaller openings on said rear surface side and larger openings on said front surface side, the minimum width of each through-hole of said porous metal plate being not more than 0.3 mm and each through-hole on the rear surface side being covered with a molten material of an inorganic dielectric containing glass.

2. The plasma display panel according to claim 1 wherein a material for air-tightly sealing said through-holes is formed within 0.1 mm from the rear surface side of said porous metal plate.

3. The plasma display panel according to claim 1 wherein said porous metal plate is in contact with said front glass plate and is made of a material having a thermal expansion coefficient close to the thermal expansion coefficient of glass.

4. The plasma display panel according to claim 1 wherein said porous metal plate has a thickness of 0.1 mm and said display cells have a pitch of 0.15 mm.

5. The plasma display panel device according to claim 1 wherein the display panel has a peripheral portion and an orifice for exhaust and gas sealing is formed in said peripheral portion of said display panel device and dot-like or stripe structures for sealing said metal plate to said front glass plate are formed in said peripheral portion of said display panel device.

6. The plasma display panel according to claim 1 wherein each of said smaller openings has a minimum width of not more than 0.3 mm and each of said larger openings has a cross sectional shape and a recessed portion and said smaller openings are filled with a powder material.

7. The plasma display panel according to claim 6 wherein said smaller openings have an inner surface and said porous metal plate has an inner surface, and at least a part of the inner surface of said smaller openings of said through-holes and said inner surface of said porous metal plate are coated with an inorganic dielectric, an electrode powder material is filled in each of said smaller openings and a wiring for connecting these electrodes is formed on said inorganic dielectric coated on each of the inner surfaces of said smaller openings and said porous metal plate.

8. A porous metal plate for a plasma display panel device having through-holes arranged in a matrix manner and having substantially the same size, said porous metal plate having a display front surface side and a rear surface side, said through-holes have smaller openings having a minimum width of not more than 0.3 mm on the rear surface side and larger openings on the display front surface side, said larger openings having recessed portions on said display front surface side, said smaller openings having an inner surface, at least a part of said inner surface of said smaller openings of said through-holes being coated with an inorganic dielectric, a powder material for forming an electrode is filled in each of said smaller openings, a wiring for connecting these electrodes is formed on said inorganic dielectric coated on each of the inner surfaces of said smaller openings, said smaller opening portions being air-tightly sealed with glass or an inorganic material containing glass, and said larger openings having said recessed portions are used for a display cell of said plasma display panel device.

* * * * *